US009027499B1

(12) United States Patent
Clarke

(10) Patent No.: US 9,027,499 B1
(45) Date of Patent: May 12, 2015

(54) SELF-SUPPORTING BOAT COVER

(71) Applicant: Dane Clarke, Dunedin, FL (US)

(72) Inventor: Dane Clarke, Dunedin, FL (US)

( * ) Notice: Subject to any disclaimer, the term of this patent is extended or adjusted under 35 U.S.C. 154(b) by 85 days.

(21) Appl. No.: 13/790,935

(22) Filed: Mar. 8, 2013

Related U.S. Application Data

(60) Provisional application No. 61/698,873, filed on Sep. 10, 2012.

(51) Int. Cl.
*B63B 17/02* (2006.01)
*B63B 17/00* (2006.01)

(52) U.S. Cl.
CPC ..... *B63B 17/02* (2013.01); *B63B 17/00* (2013.01)

(58) Field of Classification Search
CPC ..... B63B 17/00; B63B 17/02
USPC ..... 114/351, 361, 364
See application file for complete search history.

(56) References Cited

U.S. PATENT DOCUMENTS

| | | | | |
|---|---|---|---|---|
| 2,493,833 | A | 8/1947 | Reynolds | |
| 3,354,892 | A | 11/1967 | Frieder | |
| 3,399,687 | A | 9/1968 | Frieder | |
| 3,510,998 | A | 5/1970 | Cianflone | |
| 4,075,723 | A | 2/1978 | Bareis et al. | |
| 4,768,457 | A | 9/1988 | Jones | |
| 5,632,223 | A * | 5/1997 | Bray et al. | 114/361 |
| 6,260,505 | B1 | 7/2001 | Polidan | |
| 6,725,871 | B1 | 4/2004 | Shearer et al. | |
| 6,789,495 | B2 | 9/2004 | Brower et al. | |
| 7,424,862 | B1 * | 9/2008 | Wagner | 114/361 |
| 7,555,994 | B1 | 7/2009 | Arnall | |
| 7,987,807 | B2 | 8/2011 | Mikacich | |
| 2010/0037811 | A1 | 2/2010 | Grant | |

* cited by examiner

*Primary Examiner* — Lars A Olson
(74) *Attorney, Agent, or Firm* — Gold & Rizvi, P.A.; Glenn E. Gold

(57) ABSTRACT

A kit for supporting a flexible material boat cover has a cover of flexible sheet material having a plurality of substantially parallel lateral channels formed on a bottom surface. A plurality of adjustable cross-straps are provided equal in number to the plurality of lateral channels. Each cross-strap has a pocket that is formed at each end thereof. A plurality of resilient cross-poles are provided equal in number to the plurality of lateral channels and each having a length greater than the cross-strap.

13 Claims, 12 Drawing Sheets

SELF-SUPPORTING BOAT COVER

CROSS-REFERENCE TO RELATED APPLICATION

This Non-Provisional Utility application claims the benefit of U.S. Provisional Patent Application Ser. No. 61/698,873, filed on Sep. 10, 2012, which is incorporated herein in its entirety.

FIELD OF THE INVENTION

The present disclosure generally relates to covers for small watercraft, and more particularly to a self-supporting cover for small boats.

BACKGROUND OF THE INVENTION

Boating is a popular pastime for a wide variety of people. The types of boats that boaters use typically range from small rowboats and dinghies, to medium- and large-sized fishing and cruising vessels commonly used by casual fisherman and boating enthusiasts. Other types of small- to large-sized vessels include speedboats and sailboats of all sizes. It is very common for medium- and large-sized watercraft to remain outdoors, for example, moored to a slip in a marina or kept on the side of a residence. Whether the boats are moored at a marina or trailered by the owner, the majority of boats remain outside exposed to the elements night and day. Since these boats have an integral hull, any rainfall to which they are exposed will tend to collect in the bilge area of the boat. Although many boats have a bilge pump included in their construction, owners prefer that the rainwater and other elements be diverted away from the boat interior. This function is usually performed by a cover placed over the open cockpit areas of the boat.

A typical boat cover extends over the cockpit area of a boat and those areas where rain water would have a tendency to collect. Usually, the boat cover extends from the bow to the stern, and from the port gunwale to the starboard gunwale, with a portion of the cover draping over the sides of the boat hull. The cover can have peripheral draw strings to maintain the edge of the cover close to the hull of the boat to prevent light winds from capturing the cover. Further, the cover may have regularly spaced eyelets around the periphery to permit the edges of the boat cover to be securely tied down; thereby, allowing the owner to transport the boat on the open road at highway speeds that would otherwise tend to rip off an untethered cover.

If the middle of these covers is unsupported, the cover tends to form pockets in the mid portion of the cover, where rainwater, snow (when boat is stored outdoors in the winter), or other detritus common to the geographical area can accumulate. One method of preventing the formation of such pockets and the resulting accumulation is to place a vertical pole substantially in the middle of the cover. Such a pole is of a length to raise and support the mid-portion of the cover so that the rainwater, snow, or detritus slides down the surface of the cover and over the sides of the boat. However, a single center pole supporting a majority of the cover at a single point puts the cover material under considerable stress, and after just a couple of years the cover will begin to deteriorate at that point and subject the cover to tearing.

Another method for supporting a boat cover is to permanently modify the boat by attaching opposing sockets on the port and starboard gunwales or fore and aft portions of the boat. Flexible battens of a length greater than the distance therebetween are then installed with one end in each opposing socket so that the batten is bowed upwards. In this manner, the boat cover can maintain a shape that minimizes the formation of pockets and the resultant accumulation of water, snow, or detritus. However, the battens are not completely stable and can fall while the boat cover is being placed on the boat or, when the boat is already covered, the weight of a wet boat cover can cause movement of the batten and subsequently cause the batten to fall. Also, during transportation of the boat, wind can cause the cover to "whip" and dislodge the batten. Further, such designs do not work on cabin cruisers or bowrider boats that have railings affixed to the top of the gunwales of the boat.

Therefore, a boat cover support is needed that maintains a boat cover in a self-supported configuration where there are no pockets formed that could lead to the undesirable collection of rain, snow or detritus.

SUMMARY OF THE INVENTION

The present disclosure is generally directed to a boat cover kit that satisfies the need for a self-supporting boat cover, which eliminates the formation of pockets thereon when exposed to the elements. The kit for supporting a flexible material boat cover has a cover of flexible sheet material having a plurality of substantially parallel lateral channels formed on a bottom surface. A plurality of cross-straps equal in number to the plurality of lateral channels is provided, with a pocket formed at each end of the cross-strap, and a plurality of resilient cross-poles equal in number to the plurality of lateral channels and of a length greater than the cross strap.

In another aspect, the length of the cross-straps is at least as great as the distance of a port gunwale to a starboard gunwale of a boat to which the kit is to cover.

In yet another aspect, each cross-strap includes a feature for adjusting a length thereof.

In a still further aspect, each cross-strap includes a buckle for adjusting a length of said cross-strap.

In yet a further aspect, each end of a cross-strap is affixed to the cover at a respective end of a channel such that each cross-strap is in substantial vertical registration with a respective one of the lateral channels and further wherein each pocket is positioned at an end of a respective one of the lateral channels.

In another aspect, at least one of the cross-straps includes a tie segment affixed to and extending from each end thereof.

In another aspect, the cover includes a fore tie down strap affixed to a front lateral midpoint and a rear tie down strap affixed to an aft lateral midpoint.

In a still further aspect, a self-supporting boat covering kit includes a cover of flexible sheet material having at least one tie down strap affixed thereto. A support web has a plurality of laterally extending substantially parallel flexible channels longitudinally spaced one from the other and at least one longitudinal center strap affixed to a midpoint of each flexible channel for maintaining the longitudinal spacing. A plurality of cross-straps equal in number to the plurality of lateral channels are included, each cross-strap having a pocket formed at each end thereof, and a plurality of resilient cross-poles equal in number to the plurality of lateral channels and of a length greater than the cross-strap.

In yet another aspect, the support web further includes a longitudinal side strap affixed to the flexible channels proximate to a port side thereof and a longitudinal side strap affixed to the flexible channels proximate to a starboard side thereof.

In another aspect, the cover includes a fore tie down strap affixed to a front lateral midpoint and a rear tie down strap affixed to an aft lateral midpoint.

In still another aspect, a length of the cross-straps is at least as great as the distance of a port gunwale to a starboard gunwale of a boat to which said kit is to cover.

In yet another aspect, the cross-straps have a plurality of lengths.

In another aspect, each cross-strap includes a feature for adjusting a length thereof.

In still another aspect, each cross-strap includes a buckle for adjusting a length of said cross-strap.

In yet another aspect, at least one of the cross-straps includes a tie segment affixed to and extending from each end thereof.

In a still further aspect, a method of covering a boat includes obtaining a boat covering kit having a cover of flexible sheet material with a plurality of substantially parallel lateral channels formed on a bottom surface, a plurality of cross-straps equal in number to the plurality of lateral channels and having a pocket formed at each end thereof, and a plurality of resilient cross-poles longer than the cross-straps and equal in number to the plurality of lateral channels. One of the plurality of resilient poles in inserted through each of the lateral channels, and a first end of each of the resilient poles is inserted in the pockets at the first end of the cross-straps. The resilient poles are bowed upwardly to form an upwardly extending arch, and a second end of each of the resilient poles is inserted in the pockets at the second end of the cross-straps. The assembled cover, poles, and strap are placed on the top of the boat, and the assembled cover, poles, and strap is secured to the boat.

In another aspect, the cross-straps are adjustable with respect to their length and include the step of adjusting the length of each cross-strap slightly longer than the distance between the port gunwale and the starboard gunwale of the boat.

In another aspect, the cover includes a fore tie down strap affixed to a front lateral midpoint and a rear tie down strap affixed to an aft lateral midpoint wherein the securing step includes securing the fore tie down strap to the bow of the boat and securing the aft tie down strap to the stern of the boat.

In a still further aspect, each of the cross-straps includes a tie segment affixed to and extending from each end thereof and further wherein the securing step further includes securing each tie segment of the cross-straps to a structural element outboard of the port and starboard gunwales of the boat.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 11:
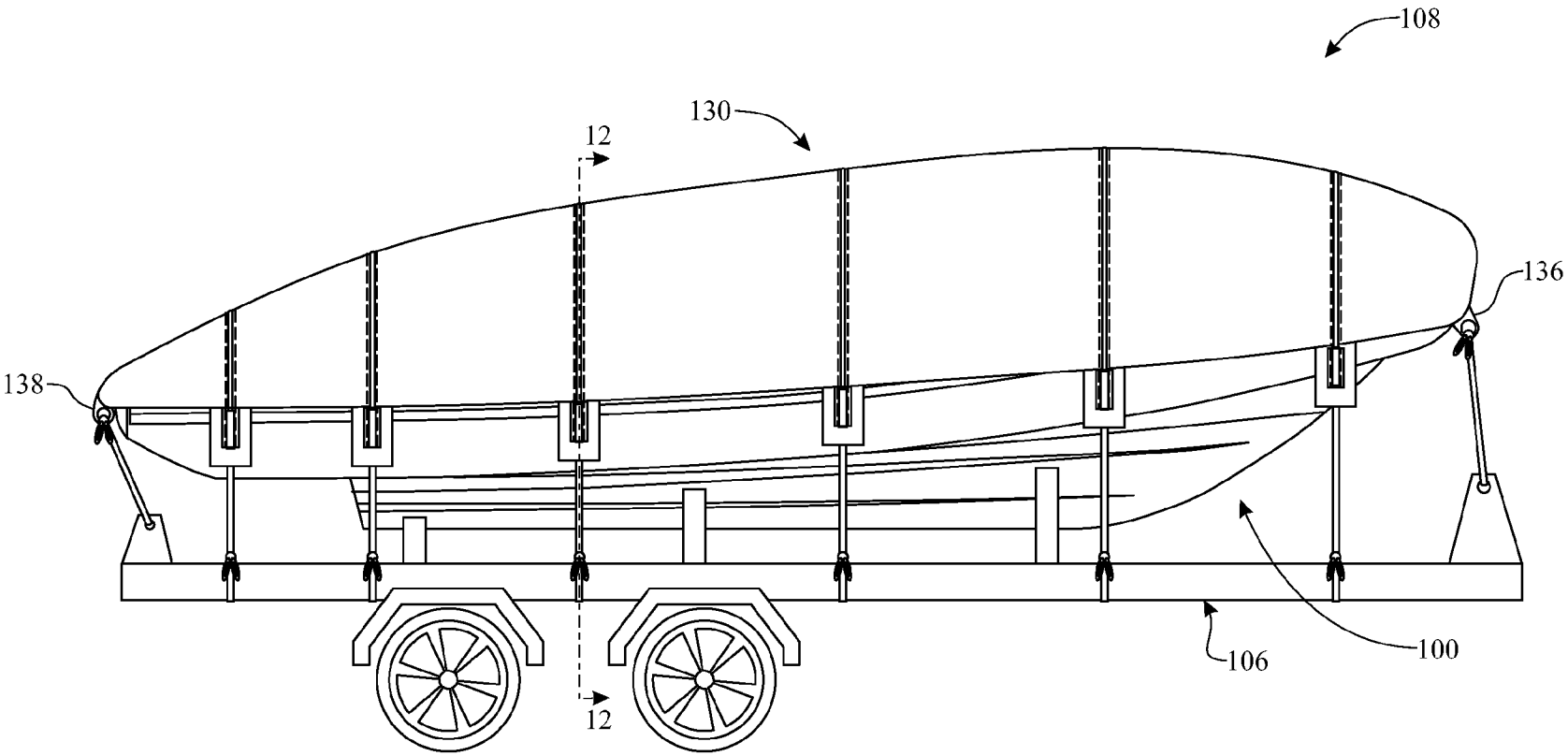
FIG. 11 presents a side elevation view of the boat with the boat cover on the boat and secured to the cross straps.

In one exemplary implementation of the invention, a kit 108 for a self-supporting boat cover is shown installed on a boat 100 in FIG. 11. The kit 108 includes a plurality of resilient cross-poles 110, a boat cover 130, and a plurality of adjustable cross-straps 140.

Figure 1:
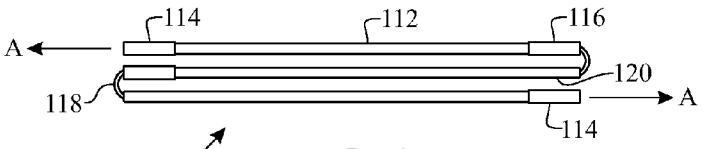
FIG. 1 presents a front elevation view of a foldable flexible pole in its folded state.
Figure 2:
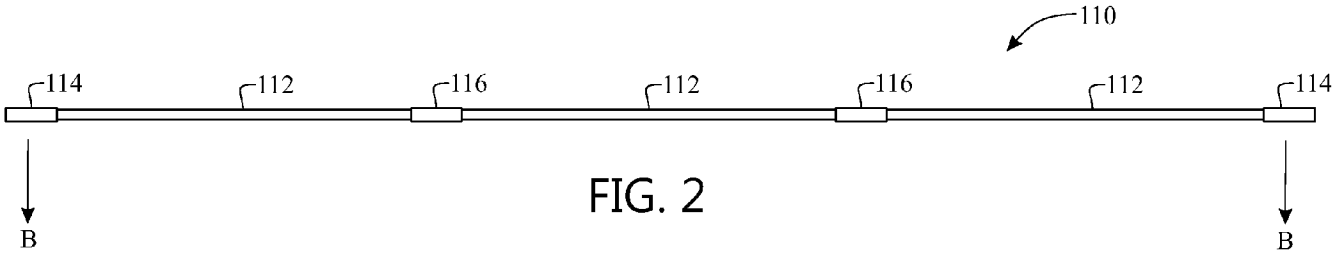
FIG. 2 presents a front elevation view of the foldable flexible pole in its extended state.
Figure 3:
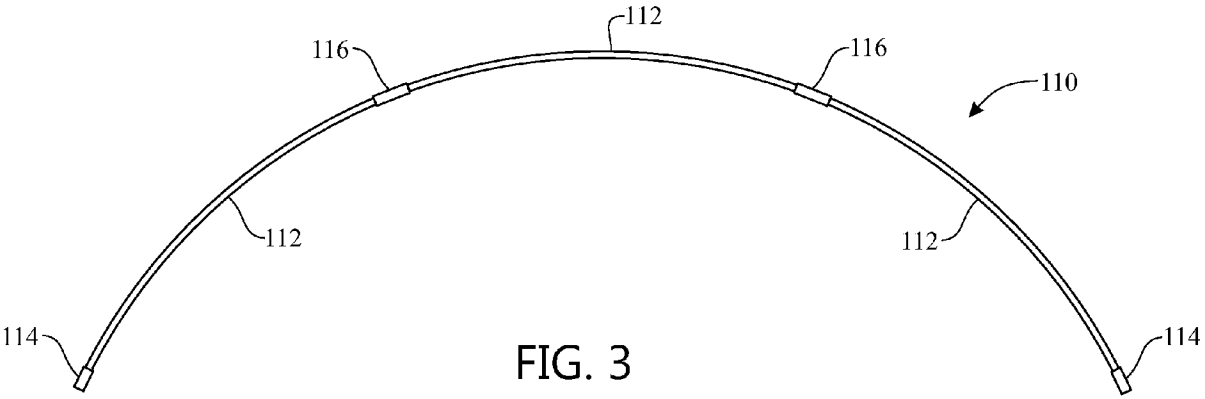
FIG. 3 presents a front elevation view of the foldable flexible pole in its extended bowed state.

The configuration of resilient cross-poles 110 are most clearly shown in FIGS. 1 through 3 where each cross-pole 110 includes a plurality of resilient hollow segments 112 of a desired length. End segments 112 have at a distal end thereof an end ferrule 114 affixed thereto such that end ferrules 114 designate the ends of each resilient cross-pole 110. The individual resilient segments 112 have a connector 116 affixed to an end of the segment 112 wherein each connector 116 includes a hollow portion to receive an end of an adjacent resilient segment 116 therein such that a single connector 116 connects adjacent ones of resilient segments 112. An elastic cord 120 is affixed to each end ferrule 114 and extends through segments 112 and connectors 116.

To assemble resilient cross-pole 110, end ferrules 114 are pulled according to Arrows "A" (FIG. 1), the ends of segments 112 are drawn into the hollow portions of connectors 116, thus forming a contiguous resilient cross pole 110, as illustrated in FIG. 2. When end ferrules of the contiguous resilient cross pole 110 are drawn downwardly as indicated by Arrows "B", and the resiliency of segments 112 are utilized, cross-pole 110 can be formed into an arcuate shape as illustrated in FIG. 3.

Figure 4:
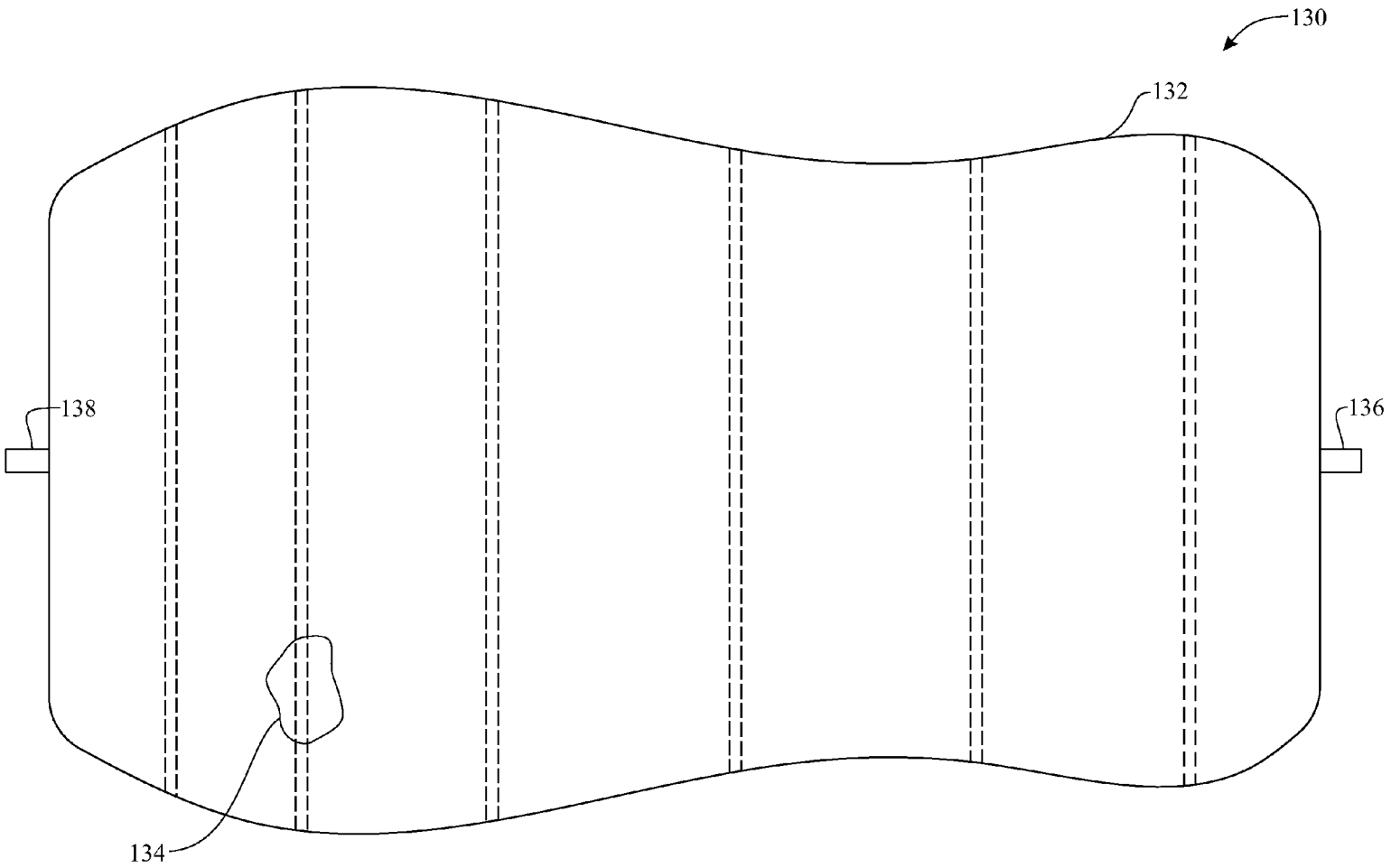
FIG. 4 presents a top view of a boat cover with lateral pole channels.

A boat cover 130 constructed of a sheet of flexible material 132 having an outer form shaped to conform to boat 100 is illustrated in FIG. 4. The boat cover 130 can include a fore tie down 136 and an aft tie down 138 affixed to the lateral midpoint of the fore and aft ends of the boat cover 130 respectively. A plurality of channel forming strips 134 are affixed to a bottom surface of flexible material sheet 132, in an arrangement forming a plurality of port-to-starboard extending lateral channels spaced along a length of the boat cover 130 from fore to aft. The number of resilient cross-poles 110 is preferably equal to the number of channels 134 in the boat cover 130.

Figure 5:
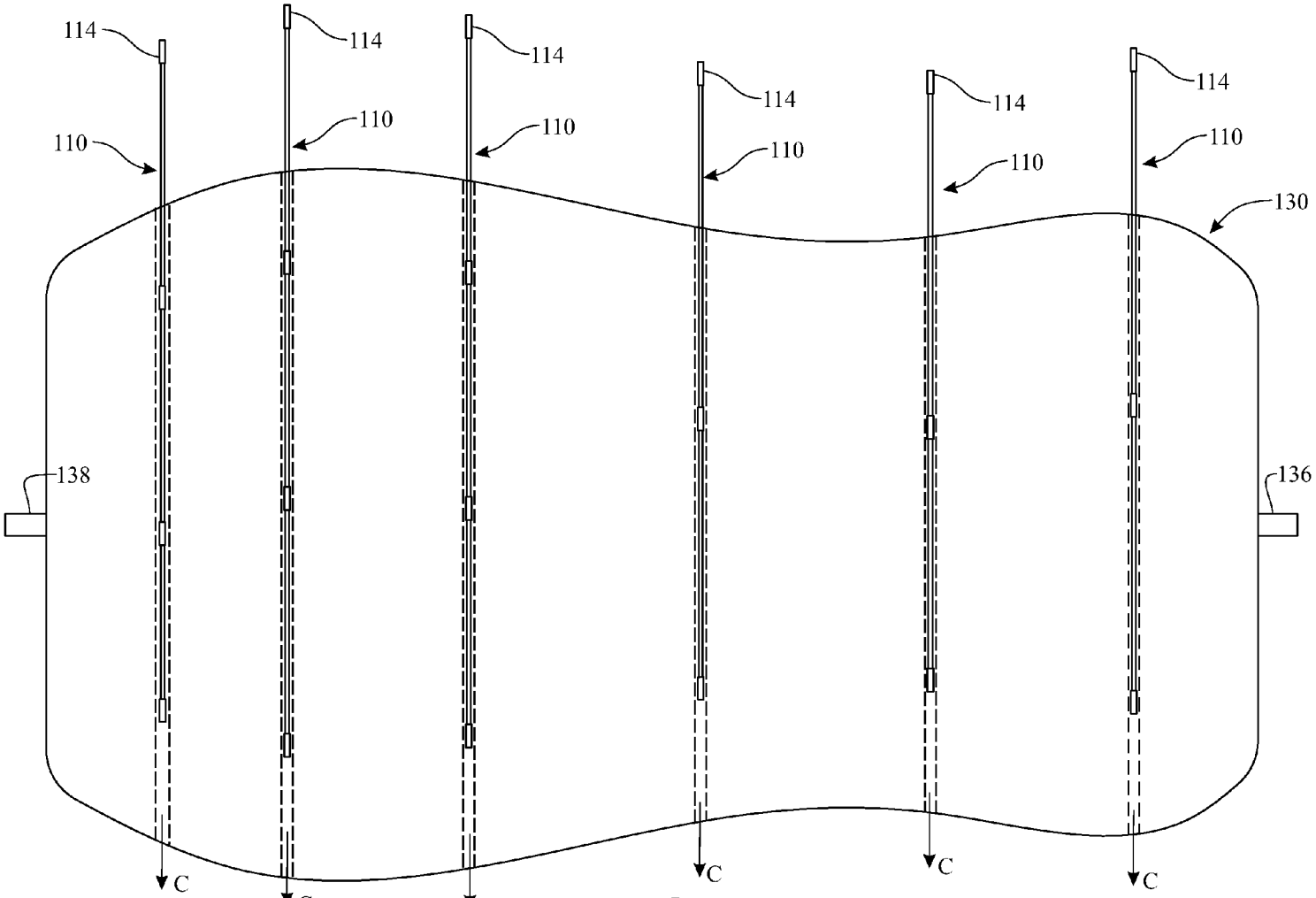
FIG. 5 presents a top view of the boat cover with flexible poles partially inserted into the lateral pole channels.
Figure 6:
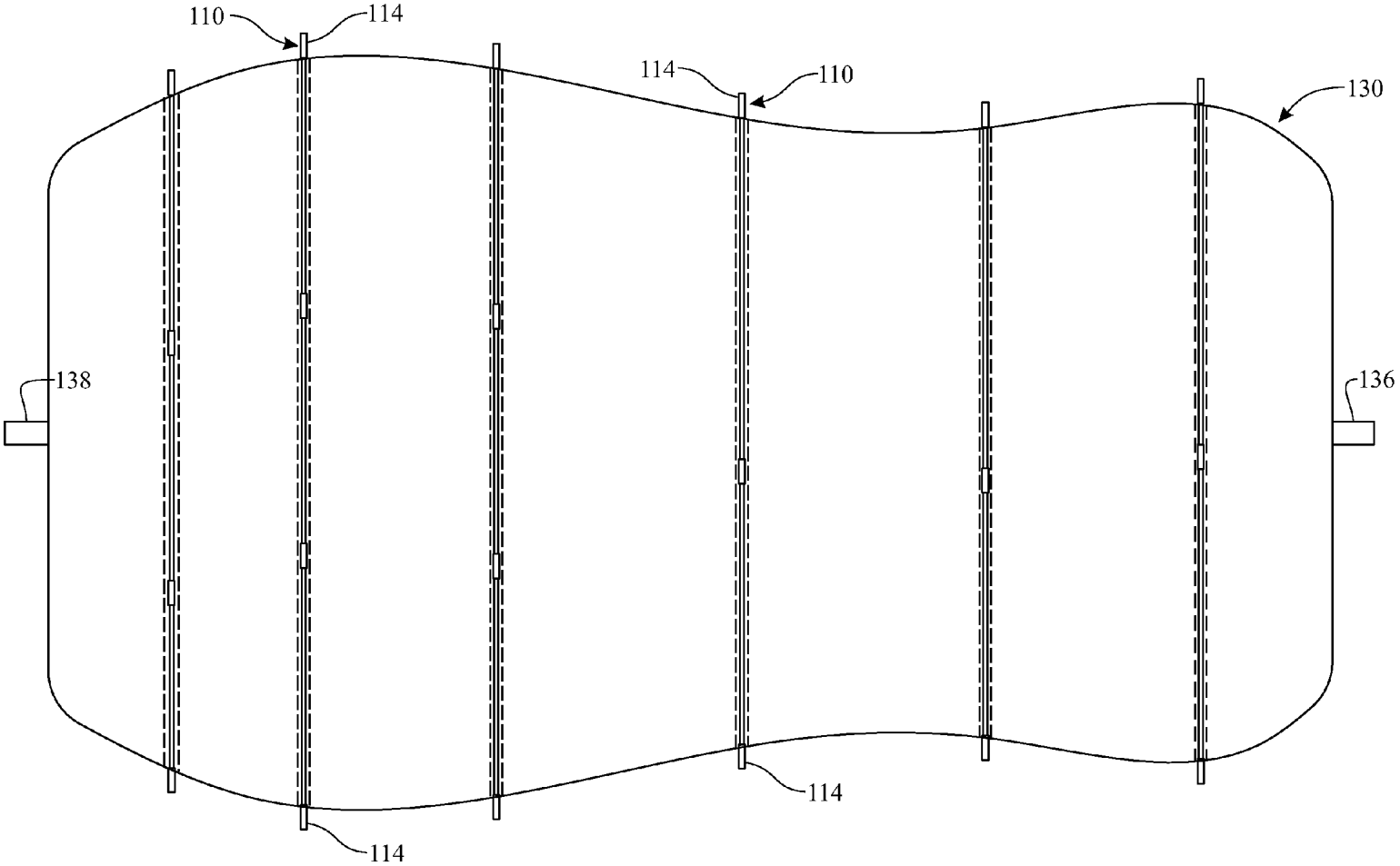
FIG. 6 presents a top view of the boat cover with flexible poles fully inserted into the lateral pole channels.

One resilient cross-pole 110 is inserted into each lateral channel of boat cover 130 as illustrated in FIG. 5 (as indicated by directional Arrows "C"). The resilient cross-poles 110 are properly positioned when the end ferrules 114 of each resilient cross-pole 110 extends from both the port and starboard sides of boat cover 130 as further illustrated in FIG. 6.

Figure 7:
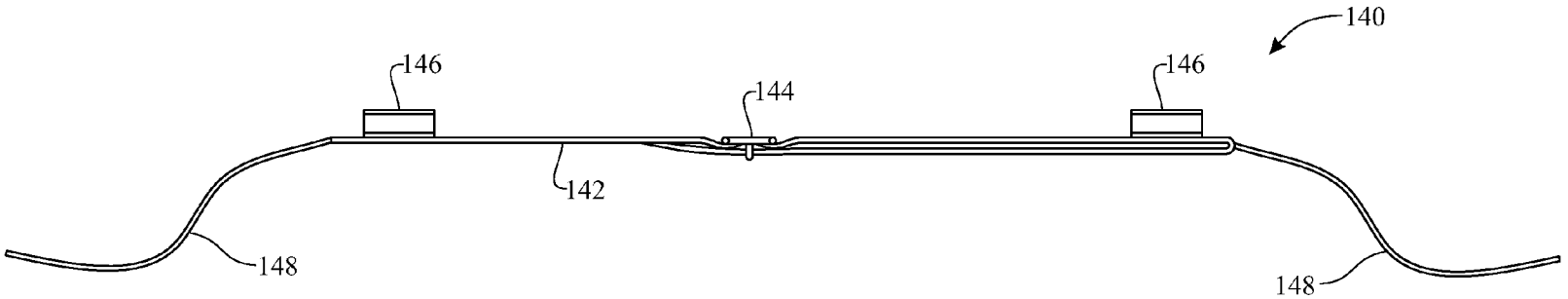
FIG. 7 presents a front elevation view of an adjustable cross strap.
Figure 8:
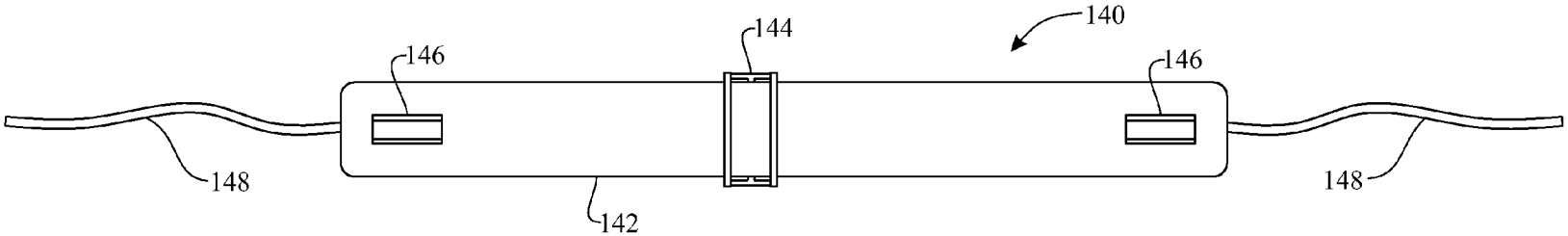
FIG. 8 presents a top plan view of an adjustable cross strap.

A plurality of cross-straps 140 equal in quantity to the number of resilient cross-poles 110 are also provided in the kit 108 for the self-supporting boat cover. Each cross-strap 140 includes, as best illustrated in FIGS. 7-8, a center portion 142 that is formed of a wide flat strap. Center portion 142 is arranged in combination with an adjustment buckle 144 in a well-known manner to permit the lengthwise adjustment of center portion 142. A pocket 146 is formed at each end of center portion 142. A tie segment 148 can also extend from each end of center portion 142. The tie segment 148 can be a rope or other flexible cord-like segment that can be securely tied into a knot. Alternatively, the adjustable feature of cross-straps 140 can be eliminated and the cross-straps 140 are then custom formed to desired lengths according to their respective placement along the length of the boat 100.

Figure 9:
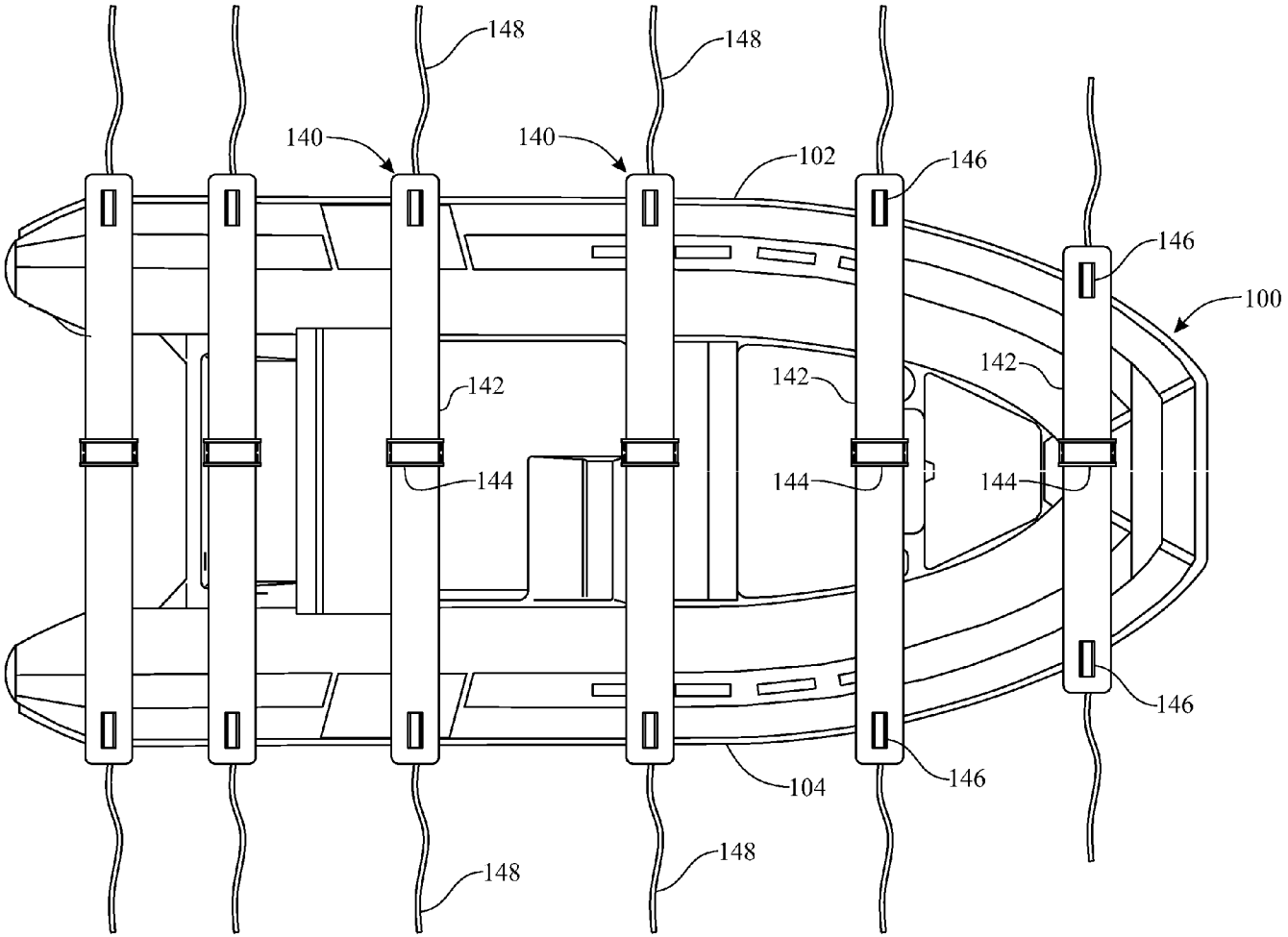
FIG. 9 presents a top plan view of a plurality of cross straps arranged on a boat in a laterally oriented configuration.

Referring primarily to FIG. 9, to install the self-supporting boat cover kit 108 on a boat, each cross-strap 140 is placed laterally across a boat from port gunwale 102 to starboard gunwale 104 in an arrangement that corresponds to the fore-to-aft spacing of the resilient cross-poles 110 in the lateral channels of boat cover 130. The length of center portions 142 of each cross-strap 140 is adjusted using adjustment buckle 144 such that the pockets 146 at each end thereof drape over the port and starboard gunwales 102, 104 of the boat 100.

Figure 10:
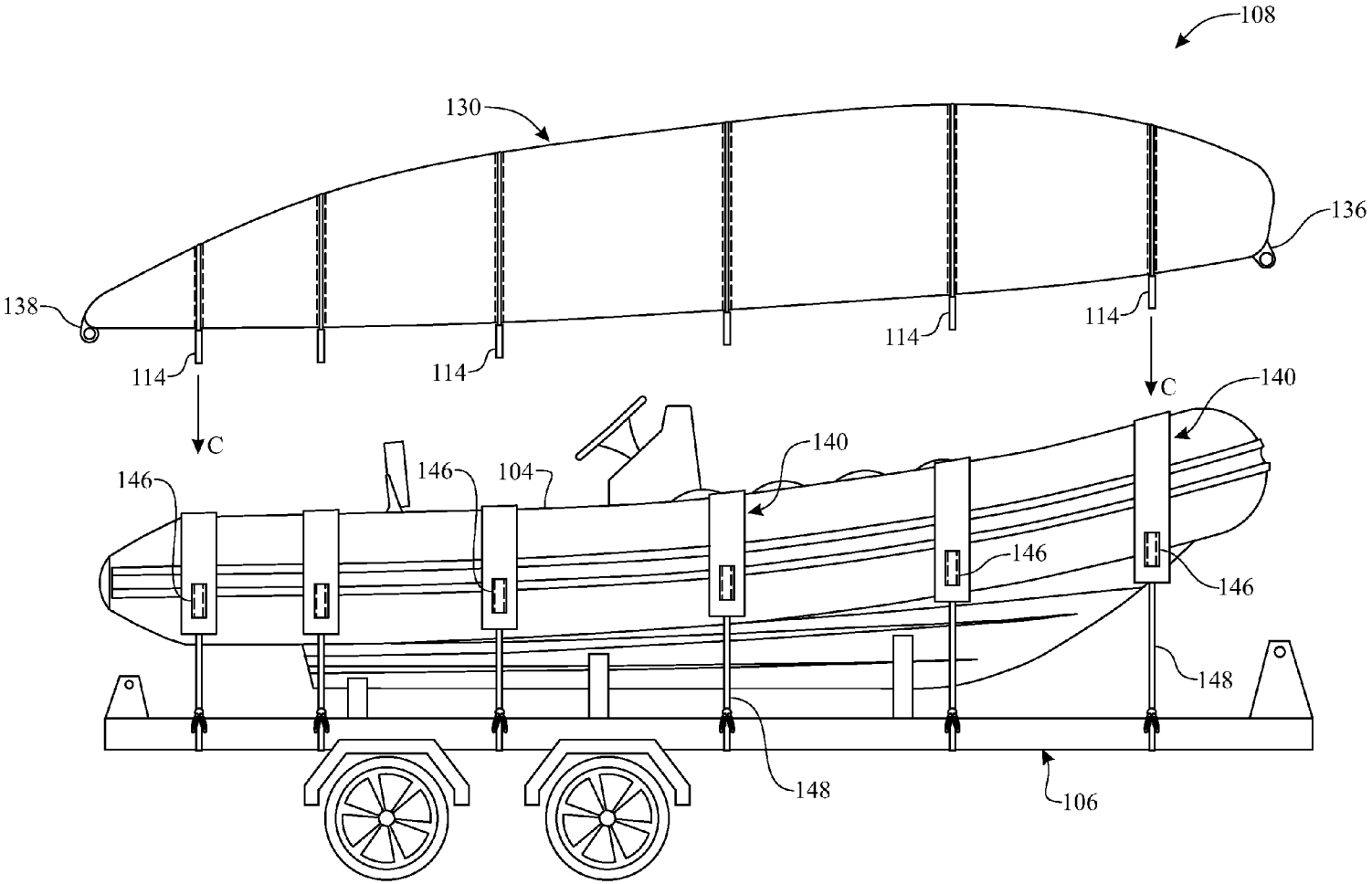
FIG. 10 presents a side elevation view of the boat with secured cross straps and the boat cover being lowered on the boat.
Figure 12:
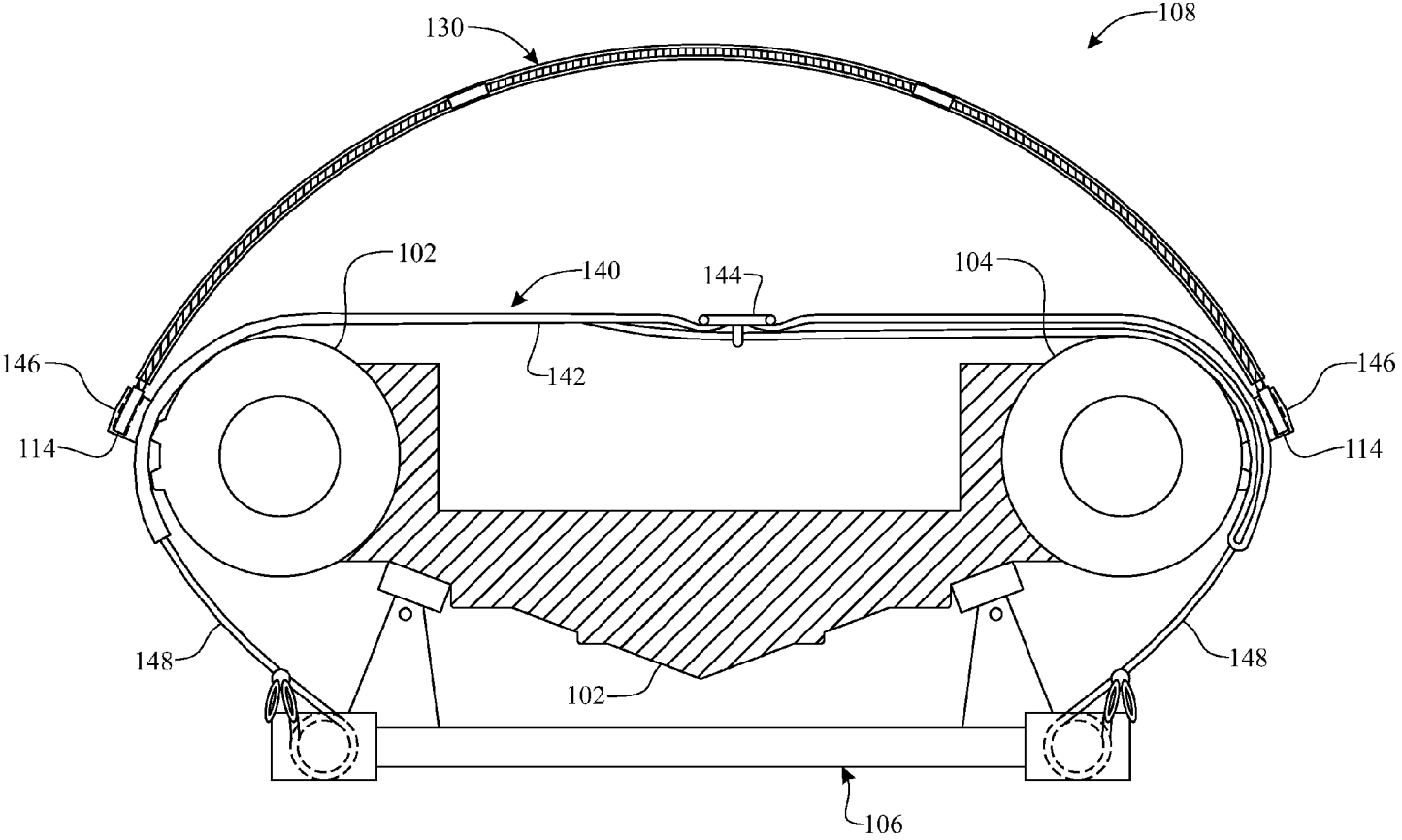
FIG. 12 presents a rear elevation cross-sectional view of the boat and boat cover of FIG. 11 taken along section line 12-12 of FIG. 11.

As best shown in FIGS. 10-12, the tie segments 148 of each cross-strap 140 are securely tied to a structural element outboard of the port and starboard gunwales 102, 104. Such structural elements can be affixed to the outer hull of boat 100 or, as illustrated in the Figures, the tie segments 148 of each cross-strap can be secured to the structure of a boat trailer 106 on which boat 100 is to be transported. The resilient cross-poles 110 are then arcuately formed, as best shown in FIG. 3, while installed in the channels of the boat cover 130. The end ferrules 114 extending from boat cover 130 are inserted into respective pockets 146 of the respective plurality of cross-straps secured over boat 100 and tied to boat trailer 106. The tie segments 148 are optional and can be omitted from the cross-straps 140. The resilient cross-poles when arcuately formed and placed in the pockets 146 of cross-straps 140 form a self-supporting structure for maintaining the cover 130 in a raised configuration. In the absence of tie segments 148, the cover, poles, and cross-straps can be secured to the boat 100 by securing the fore tie down 136 to the bow of boat 100 and the aft tie down 138 to the stern of the boat 100.

As installed in such manner, the resiliency of the cross poles 110 maintains boat cover 130 in a self-supported configuration, eliminating the need for a central support pole used with conventional boat covers. The resilient cross-poles maintain the arcuate shape illustrated in FIG. 3, since the lateral distance between the pockets 146 in each cross strap is less than the extended length of each resilient cross-pole 110, as most clearly illustrated in FIG. 12. The arced cross-poles 110 supporting the boat cover 130 eliminate pockets where water, snow, or detritus could otherwise collect over time.

Figure 13:
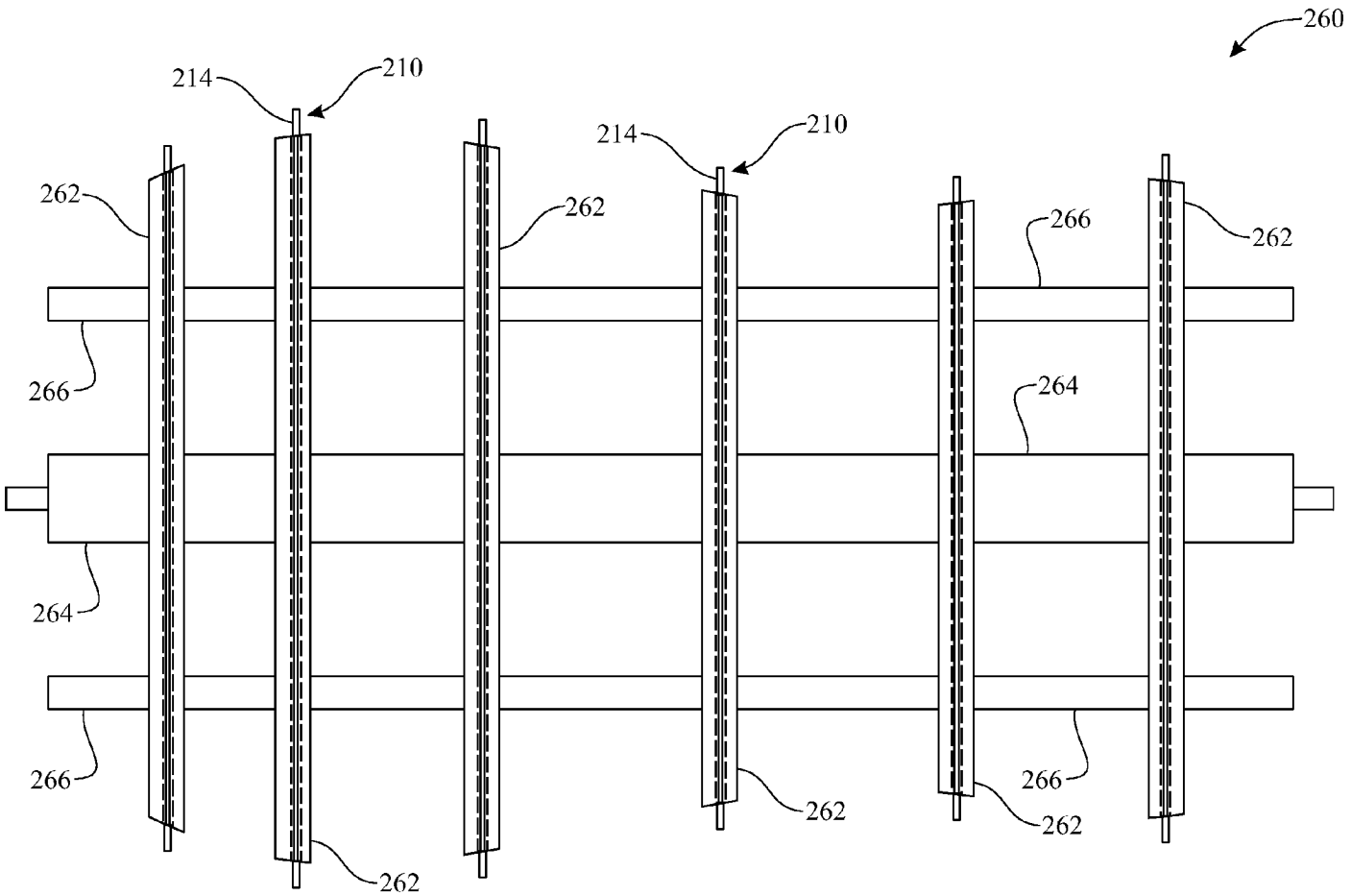
FIG. 13 presents an alternate embodiment configuration of a structure for supporting a boat cover on a boat.
Figure 14:
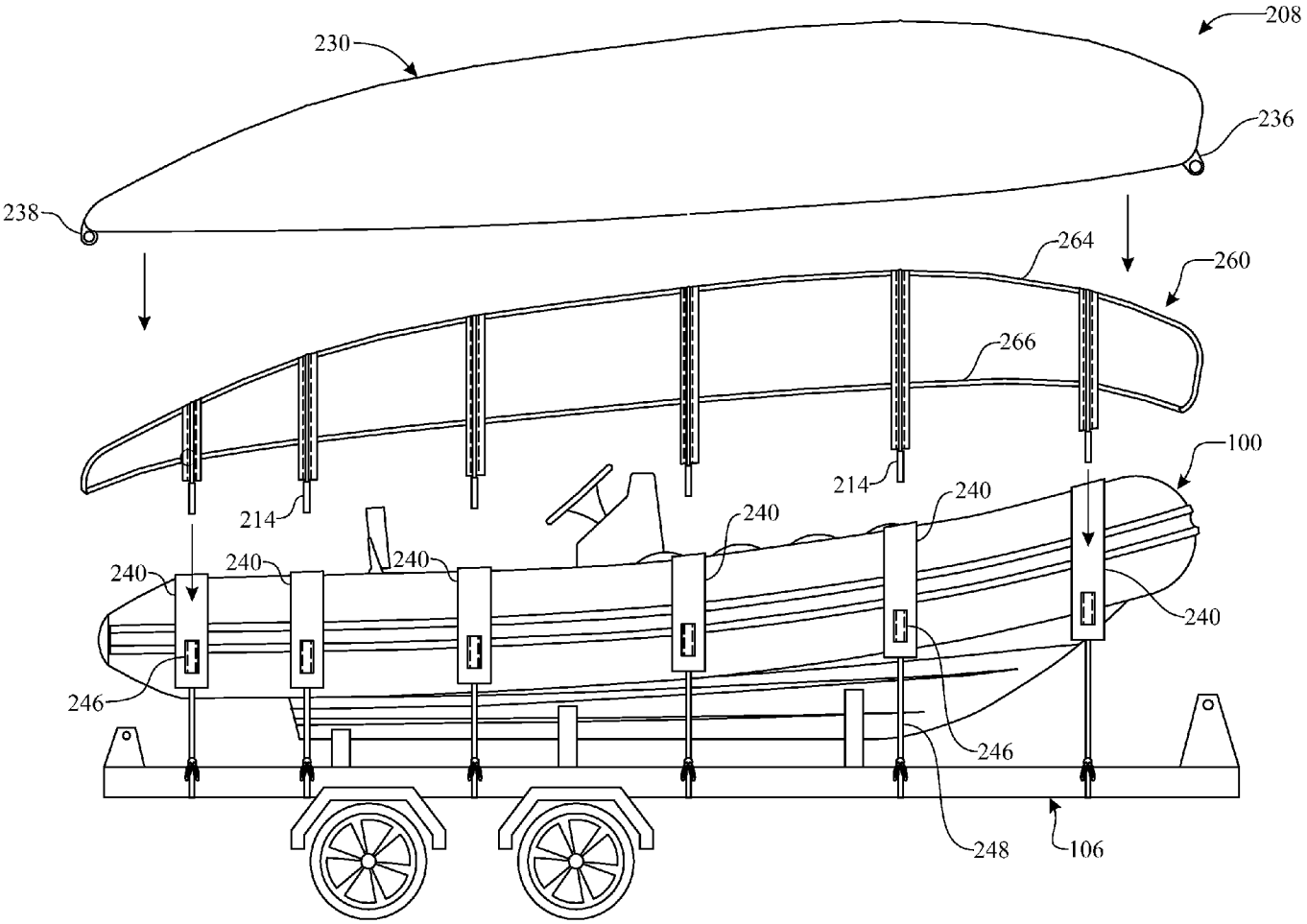
FIG. 14 presents an exploded side elevation view of a boat and cover wherein the cover is supported by a cover supporting structure.

Referring now to FIGS. 13 through 14, a further exemplary implementation of the boat cover kit 208 is illustrated, wherein like elements to kit 108 are identified with like reference numbers preceded by the numeral "2" instead of the numeral "1". The boat cover kit 208 includes a plurality of resilient cross-poles 210 and a like number of adjustable cross-straps 240. A boat cover 230 is formed from a flexible sheet material to fit the form of boat 100.

A support web 260 is formed of a plurality of lateral channels 262, which are equal in quantity to the number of resilient cross-poles 210 and are spaced one from the other from fore to aft of the boat 100. Lateral channels 262 are flexible in construction and can be formed from a woven material or can be of a different flexible material such as, for example, nylon. A longitudinal center strap 264 extends from fore to aft of the boat 100, and has affixed thereto the midpoints of lateral channels 262, to provide the desired fore to aft spacing of lateral channels 262. A longitudinal side strap 266 can also be affixed to lateral channels 262 proximate to a port side of support web 260, and a second longitudinal strap 266 can be affixed to lateral channels 262 proximate to a starboard side of support web 260. The combination of longitudinal straps 264,266 and lateral channels 262 receiving therein the plurality of resilient cross-poles 210 form the structural web 260.

Referring now primarily to FIG. 14, to install the kit 208 on boat 100, the cross-straps 240 are affixed across boat 100 in a manner similar to straps 140 as described above. The support web 260 is then installed on the boat 100 by inserting end ferrules 214 of resilient cross-poles 210 into pockets 246 of cross-straps 240 such that the cross-poles 210 are bowed upwardly. The longitudinal straps 264, 266 of support web 260 maintain cross-poles 210 in a substantially vertical orientation and prevent cross-poles 210 from tilting fore and aft. Boat cover 230 is then placed over support web 260 and secured to boat 100 by securing fore and aft tie downs, 236 and 238, respectively, to the support web 260 and also securing intermediate points of boat cover 230 to support web 260 and boat 100. The bowed cross-poles 210 supporting web 260 and cover 230 prevent the formation of pockets in which water, snow, or detritus could collect.

Figure 15:
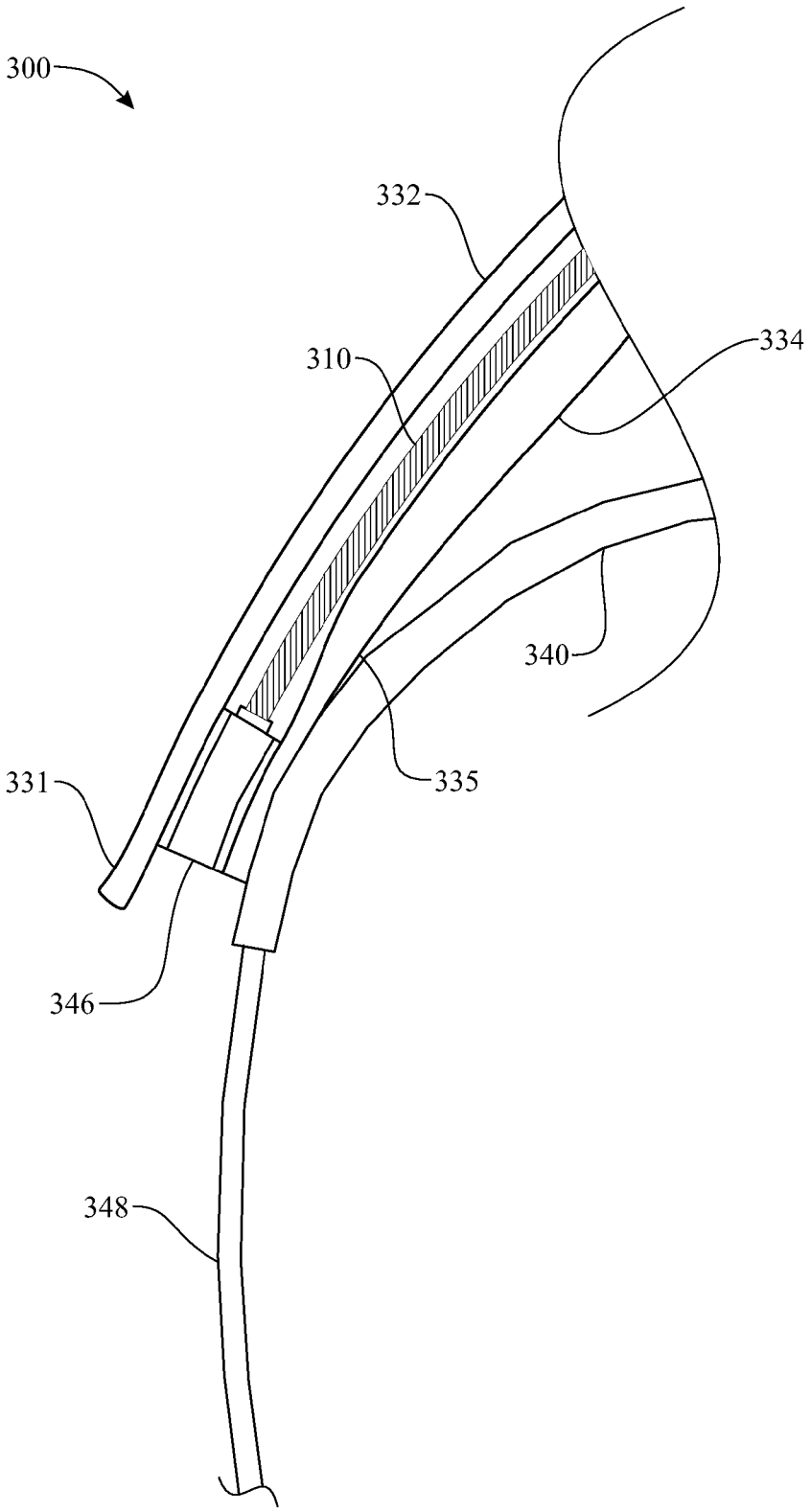
FIG. 15 presents a partial rear elevation cross-sectional view of an alternate embodiment boat cover.

An alternate embodiment boat cover kit 300 is illustrated in FIG. 15 wherein a boat cover 330 is constructed of a sheet of flexible material 332 and has an outer form shaped to conform to a boat such as boat 100 (FIG. 14) to which the boat cover 330 is to be attached. A plurality of channel forming strips 334 are affixed to a bottom surface of the flexible material sheet 332 in an arrangement forming a plurality of port-to-starboard extending lateral channels spaced along a length of the boat cover 330 from fore to aft. Each channel forming strip 334 terminates with an end portion 335 proximate to edge 331 of the boat cover 330. A cross strap 340 is positioned substantially in vertical registration with each channel forming strip 334 and extends between respective edges of 331 of the boat cover 330. Cross strap 340 can include a buckle 344 to facilitate adjustment of the length of the cross strap 340. Each end of cross strap 340 terminates at the end portions 335 of channel forming strip 334 and is affixed thereto. Further, a pocket 346 is also affixed to the end portion 335 of channel forming strip 334 in a manner to receive an end of a flexible cross-pole 310 received in the channel defined by channel forming strip 334 and flexible sheet 332. In this manner, cross straps 340 remain affixed to boat cover 330. Tie segments 348 can be affixed to the ends of cross straps 340 to aid in securing the assembled boat cover kit 300 to an exterior of the boat 100 (FIG. 14) or to a boat trailer 106 (FIG. 14).

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A self-supporting boat covering kit, comprising:

a cover of flexible sheet material having at least one tie down strap affixed thereto;

a support web having a plurality of laterally extending substantially parallel flexible channels longitudinally spaced one from said other and at least one longitudinal center strap affixed to a midpoint of each flexible channel for maintaining said longitudinal spacing;

a plurality of cross-straps equal in number to said plurality of lateral channels, each cross-strap having a pocket formed at each end thereof; and a plurality of resilient cross-poles equal in number to said plurality of lateral channels and of a length greater than said cross-strap.

2. The self-supporting boat covering kit according to claim 1, wherein said support web further comprises a longitudinal side strap affixed to said flexible channels proximate to a port side thereof and a longitudinal side strap affixed to said flexible channels proximate to a starboard side thereof.

3. The self-supporting boat covering kit according to claim 1, wherein said cover further comprises a fore tie down strap affixed to a front lateral midpoint and a rear tie down strap affixed to an aft lateral midpoint.

4. The self-supporting boat covering kit according to claim 1, wherein a length of each of said plurality of cross-straps is at least as great as a distance between a port gunwale and a starboard gunwale of a boat to which said kit is to cover.

5. The self-supporting boat covering kit according to claim 4, wherein said plurality of cross-straps has a plurality of lengths.

6. The self-supporting boat covering kit according to claim 4, wherein each of said plurality of cross-straps further comprises a feature for adjusting said length thereof.

7. The self-supporting boat covering kit according to claim 6, wherein each of said plurality of cross-straps further comprises a buckle for adjusting said length of said cross-strap.

8. The self-supporting boat covering kit according to claim 7, wherein at least one of said plurality of cross-straps further comprises a tie segment affixed to and extending from each end thereof.

9. A method of covering a boat comprising steps of:

obtaining a boat covering kit having a cover of flexible sheet material with a plurality of substantially parallel lateral channels formed on a bottom surface, a plurality of cross-straps equal in number to said plurality of lateral channels and having a pocket formed at each end thereof, and a plurality of resilient cross-poles longer than said cross-straps and equal in number to said plurality of lateral channels;

inserting one of said plurality of resilient poles through each of said lateral channels;

inserting a first end of each of said resilient poles in said pockets at said first end of said cross-straps;

bowing said resilient poles upwardly to form an upwardly extending arch;

inserting a second end of each of said resilient poles in said pockets at said second end of said cross-straps;

placing said assembled cover, poles, and strap on said top of said boat; and securing said assembled cover, poles, and strap to said boat.

10. The method of covering a boat according to claim 9, wherein each of said plurality of cross-straps is adjustable with respect to its length and further comprising a step of: adjusting said length of each cross-strap slightly longer than said distance between a port gunwale and a starboard gunwale of said boat.

11. The method of covering a boat according to claim 9, wherein said cover further comprises a fore tie down strap affixed to a front lateral midpoint of said cover and a rear tie down strap affixed to an aft lateral midpoint of said cover wherein said securing step further comprises:

securing said fore tie down strap to a bow of said boat and securing said aft tie down strap to a stern of said boat.

12. The method of covering a boat according to claim 11, wherein each of said plurality of cross-straps further comprises a tie segment affixed to and extending from each end thereof and wherein said securing step further comprises:

securing each tie segment of said cross-straps to a structural element outboard of each respective port and starboard gunwale of said boat.

13. The method of covering a boat according to claim 9, wherein each of the plurality of cross-straps further comprises a tie segment affixed to and extending from each end thereof and wherein the securing step further comprises:

securing each tie segment of the cross-strap to a structural element outboard of the port and starboard gunwales of the boat.

* * * * *